US007029270B2

(12) United States Patent
Wong

(10) Patent No.: US 7,029,270 B2
(45) Date of Patent: Apr. 18, 2006

(54) IGNITER WITH SAFETY LOCK

(76) Inventor: Chi Lam Wong, 1617 Euclid Ave., San Gabriel, CA (US) 91776

( * ) Notice: Subject to any disclaimer, the term of this patent is extended or adjusted under 35 U.S.C. 154(b) by 29 days.

(21) Appl. No.: 10/681,678

(22) Filed: Oct. 8, 2003

(65) Prior Publication Data

US 2005/0079460 A1 Apr. 14, 2005

(51) Int. Cl.
*F26D 11/36* (2006.01)

(52) U.S. Cl. ..... 431/153

(58) Field of Classification Search ..... 431/153, 431/255, 277, 130, 345, 266; 126/408, 401, 126/410, 25 B
See application file for complete search history.

(56) References Cited

U.S. PATENT DOCUMENTS 2,791,110 A * 5/1957 Gellman ..... 431/140
6,318,992 B1 * 11/2001 Sung ..... 431/153
6,386,860 B1 * 5/2002 Adams et al. ..... 431/153
6,431,853 B1 * 8/2002 Sher ..... 431/153
6,533,575 B1 * 3/2003 Man ..... 431/153
6,666,679 B1 * 12/2003 Ye ..... 431/153
2002/0115031 A1 * 8/2002 Chen ..... 431/153

* cited by examiner

*Primary Examiner*—S. Gravini
(74) *Attorney, Agent, or Firm*—Raymond Y. Chan; David & Raymond

(57) ABSTRACT

An igniter (or lighter) having a safety lock includes a housing; a gas supply in the housing and having an outlet valve; a combustion nozzle fluid connected to the outlet valve; a conventional igniter for igniting gas at the outlet nozzle; a finger-operable slider for opening the outlet valve and activating the igniter to ignite the gas when the slider is moved from its rest position; a finger-operable thumbwheel having a lock position for blocking movement of the slider from the rest position, and a spring biasing the thumbwheel to the lock position, wherein movement of the thumbwheel from the lock position is by finger operation in a direction opposite to finger operation of the first movable member from the rest position.

20 Claims, 2 Drawing Sheets

IGNITER WITH SAFETY LOCK

BACKGROUND

The present invention relates to an igniter, and more particularly to an igniter that uses inflammable gas as fuel stored in liquidity and having a safety lock.

Existing igniters of the prior art that use inflammable gas such as butagas as fuel stored in liquidity typically include the following:

1. A housing;
2. A gas storage element having an outlet valve connected to the interior of the housing;
3. A combustion nozzle connected to an outlet valve in a storage assembly;
4. An outlet control means provided in the housing;
5. An igniting means provided in the housing; and
6. A sliding switch provided in the housing for activating the igniting means.

The manner of igniting such a lighter is to directly push the sliding switch to release gas from the outlet valve while activating the igniting means to produce a spark that inflames the gas being sprayed from the combustion nozzle. Thus ignition can be produced by a single action to produce a high-temperature flame. Consequently, there is dangerous potential for injury if the switch is played with or carelessly touched by children.

SUMMARY

One object of the present invention is to provide an igniter with a safety lock that prevents ignition in response to a single action for avoiding unwanted mis-operation by adults as well as hazards exposed to children. In one aspect of the invention, the igniter includes a housing; a gas supply in the housing and having an outlet valve; a combustion nozzle supported relative to the housing and fluid connected to the outlet valve; igniting means supported relative to the housing for igniting gas at the outlet nozzle; a finger-operable first movable member for opening the outlet valve and activating the igniting means to complete ignition at the outlet nozzle when the first movable member is moved from a rest position thereof; a finger-operable second movable member having a lock position for blocking movement of the first movable member from the rest position thereof, and an unlock position for permitting the movement; and means for biasing the second movable member to the lock position thereof, wherein movement of the second movable member to the unlock position thereof is by finger operation in a direction opposite to finger operation of the first movable member from the rest position. Preferably the second movable member is supported relative to the first movable member, for facilitating the finger operation by a single finger.

More preferably, and the second movable member is pivotally supported relative to the first movable member. The igniter can also include a projecting stop member supported in fixed relation to the housing, and a dog member formed on the second movable member, wherein movement of the first movable member from the rest position thereof is blocked by engagement of the dog member with the stop member when the second movable member is in the lock position. The biasing means can include a spring being coupled between the first movable member and the second movable member. The second movable member can be formed as a thumbwheel, a portion thereof projecting through a portion of the second movable member for facilitating the operation of the first and second movable members by a single hand finger.

Exposed portions of the first and second movable members are preferably serrated for facilitating the finger operation. In any of the above variations, the first movable member can be slidably supported relative to the housing.

DRAWINGS

These and other features, aspects, and advantages of the present invention will become better understood with reference to the following description, appended claims, and accompanying drawings, where:

DESCRIPTION

Figure 1:
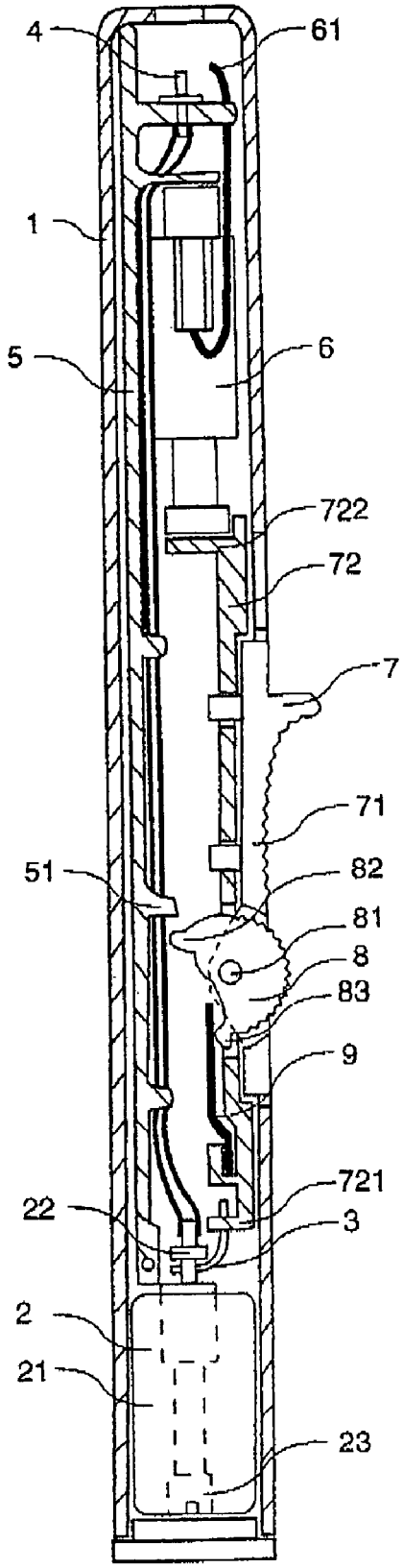
FIG. 1 is a sectional side view of an igniter according to the present invention, the igniter having a sliding switch portion being in a locked condition.
Figure 2:
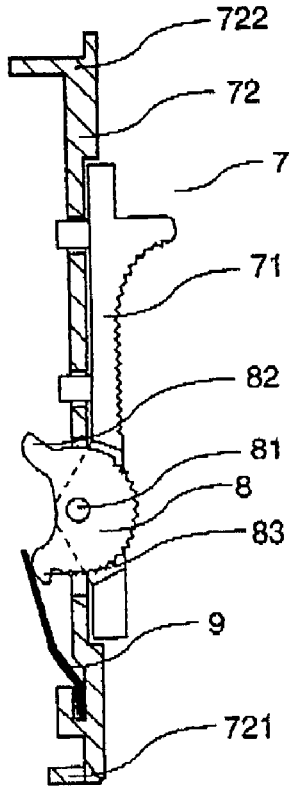
FIG. 2 is a partial sectional view as FIG. 1, showing the sliding switch portion of the igniter in an unlocked condition.

The present invention provides a novel igniter that includes a particularly effective safety lock. With reference to FIGS. 1 and 2 of the drawings, the igniter includes a housing 1, a gas storage assembly 2 supported in the housing and having a gas case 21, an outlet valve 22, and an inlet valve 23. In the exemplary configuration of FIGS. 1 and 2, the gas storage assembly 2 is located proximate one end (bottom) extremity of the housing 1. An outlet control member 3 engages the outlet valve 22 for opening same as described below. A combustion nozzle 4 is located proximate an opposite (head) end of the housing 1, being mounted to a support rack 5 that is fixedly positioned within the housing. The nozzle 4 is fluid-connected to the outlet valve 22 in a conventional manner, and an igniting means 6 having an electrode 61 positioned proximate the combustion nozzle 4 is also supported in fixed relation to the housing 1 by the support rack 5.

According to the present invention, the outlet control member 3 is operated by a first movable member that is blocked from movement unless a second movable member is first moved in a direction opposite to that of the first movable member. In the exemplary configuration of FIGS. 1 and 2, a sliding switch assembly 7 for operating the outlet control member 3 includes a sliding button 71 as the first movable member and a pulley or thumbwheel 8 as the second movable member, the sliding button 71 being mounted on a connecting member 72 having a lower end 721 to which the outlet control member 3 is affixed, and an upper end 722 that is positioned for operating the igniting means 6 when the sliding button is moved toward the combustion nozzle 4 from a rest position shown in FIG. 1, the outlet control member simultaneously lifting a core of the outlet valve 22. Preferably exposed portions of the sliding button 71 and the thumbwheel 8 are serrated and otherwise shaped for hand finger (or thumb) actuation as shown in FIG. 1; further, the thumbwheel 8 preferably projects through a portion of the sliding button 71, facilitating manipulation of both the thumbwheel and the sliding button 71 by a single finger as described below.

FIG. 1 also shows the thumbwheel 8 in a lock position for preventing upward movement of the sliding button 71, the thumbwheel being biasingly maintained in the lock position by a reset spring 9 that engages a radially projecting limiting portion or return member 83 of the thumbwheel 8, another projecting flange portion or dog 82 of the thumbwheel 8 blocking upward movement of the sliding button 71 in the rest position of the thumbwheel 8 as described below. Importantly, movement of the thumbwheel 8 from the lock position thereof is accomplished by finger movement in a direction opposite that of movement of the sliding button 71 from its rest position.

Preferably the thumbwheel 8 is supported relative to the sliding button 71 for translation therewith, being pivotally mounted thereto on a bolt or shaft 81 in appropriate relation to the sliding button, a preferred exemplary arrangement being shown in FIG. 1, such that a single finger (or thumb) can first move the thumbwheel 8 from its lock position to an unlock position as shown in FIG. 2 and, while holding the thumbwheel so moved (rotated), translate the combination of the sliding button 71 and the thumbwheel oppositely, thereby shifting the sliding switch assembly toward the combustion nozzle 4 to open the outlet valve 22 and activate the igniting means 6 as described above. As further described above, the movement of the thumbwheel 8 from its lock position is against the biasing provided by the reset spring 9 against the return member 83, the spring being a cantilevered leaf spring that is anchored on the connecting member 72; upon release, the thumbwheel 8 returns to its lock position, the return member 83 being biasingly clamped between the reset spring 9 and the connecting member 72. Unless the thumbwheel 8 is first moved to and held in the unlock position shown in FIG. 2, the upward movement of the sliding button 71 is blocked by the dog 82 of the thumbwheel coming against protrusion or stop member 51 that is integrally formed on the support rack 5. It will be understood that upon release, the sliding button 72 is returned to its downward rest position shown in FIG. 1 by suitable biasing means (not shown) such as may be provided within the igniting means 6 and/or the outlet valve 22.

Figure 3:
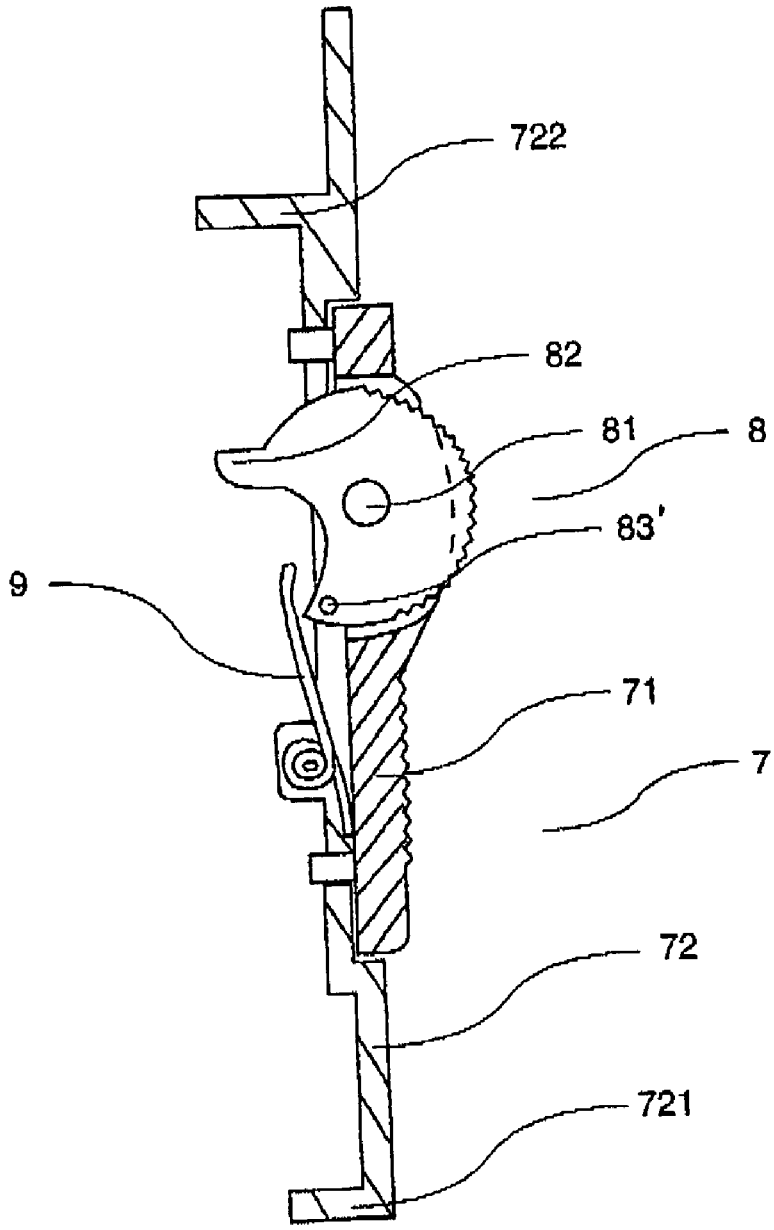
FIG. 3 is a sectional view as in FIG. 2, showing an alternative configuration of the slidin switch portion, in a locked condition.

With further reference to FIG. 3, an alternative configuration of the thumbwheel 8 has a counterpart of the return member thereof in the form of an axially projecting bolt or pin 83'. Also, the reset spring 9 can be provided in the form of a hairpin wire spring as also shown in FIG. 3, the spring engaging a cutaway portion of the thumbwheel 8 that is formed proximate the pin 83'.

Although the present invention has been described in considerable detail with reference to certain preferred versions thereof, other versions are possible. Therefore, the spirit and scope of the appended claims should not necessarily be limited to the description of the preferred versions contained herein.

What is claimed is:

1. An igniter, comprising:

a housing;

a gas supply in said housing and having an outlet valve;

a combustion nozzle supported relative to said housing and fluid connected to said outlet valve;

an igniting means supported relative to said housing for igniting gas at said combustion nozzle; and a sliding switch assembly, which comprises:

a sliding button slidably mounted on said housing for opening said outlet valve and activating said igniting means to complete ignition at said combustion nozzle when said sliding button is moved from a rest position thereof;

a thumbwheel pivotally mounted on said sliding button to rotatably move between a lock position and an unlock position, wherein at said lock position, said sliding button is locked by said thumbwheel to block a sliding movement of said sliding button for completing said ignition, and at said unlock position, said thumbwheel is pivotally rotated in a direction opposite to said sliding movement of said sliding button to permit said sliding movement of said sliding button so as to allow said sliding button to complete said ignition; and means for biasing said thumbwheel to said lock position thereof.

2. The igniter, as recited in claim 1, wherein said sliding switch assembly further comprises a connecting member which is slidably supported in said housing to support said sliding button and has a lower end extended to operate said outlet valve and an upper end extended to operate said igniting means such that when said connecting member is driven to slide by said sliding button from said rest position, said connecting member opens said outlet valve and activates said igniting means to complete ignition at said combustion nozzle at the same time.

3. The igniter, as recited in claim 1, wherein said sliding switch assembly further comprises a stop member supported within said housing at a position that said thumbwheel is blocked by said stop member at said lock position so as to block said sliding movement of said sliding button for ignition.

4. The igniter, as recited in claim 2, wherein said sliding switch assembly further comprises a stop member supported within said housing at a position that said thumbwheel is blocked by said stop member at said lock position so as to block said sliding movement of said sliding button for ignition.

5. The igniter, as recited in claim 3, wherein said thumbwheel has a projecting flange portion extended to align with said stop member to block said sliding movement of said sliding button and a return member which is extended to bias said biasing means and is arranged in such a manner that when said thumbwheel is driven to pivotally rotate, said projecting flange portion of said thumbwheel is moved to a position offset to said stop member so as to permit said sliding movement of said sliding button.

6. The igniter, as recited in claim 4, wherein said thumbwheel has a projecting flange portion extended to align with said stop member to block said sliding movement of said sliding button and a return member which is extended to bias said biasing means and is arranged in such a manner that when said thumbwheel is driven to pivotally rotate, said projecting flange portion of said thumbwheel is moved to a position offset to said stop member so as to permit said sliding movement of said sliding button.

7. The igniter, as recited in claim 2, wherein said biasing means comprises a cantilevered leaf spring having one end anchored on said connecting member and an opposed end biasing against said thumbwheel.

8. The igniter, as recited in claim 4, wherein said biasing means comprises a cantilevered leaf spring having one end anchored on said connecting member and an opposed end biasing against said thumbwheel.

9. The igniter, as recited in claim 6, wherein said biasing means comprises a cantilevered leaf spring having one end anchored on said connecting member and an opposed end biasing against said thumbwheel.

10. The igniter, as recited in claim 2, wherein said biasing means comprises a hairpin wire spring having one end anchored on said connecting member and an opposed end biasing against said thumbwheel.

11. The igniter, as recited in claim 4, wherein said biasing means comprises a hairpin wire spring having one end anchored on said connecting member and an opposed end biasing against said thumbwheel.

12. The igniter, as recited in claim 6, wherein said biasing means comprises a hairpin wire spring having one end anchored on said connecting member and an opposed end biasing against said thumbwheel.

13. The igniter, as recited in claim 1, wherein said thumbwheel is rotatably mounted at said sliding button at a position that a serrated portion of said thumbwheel is exposed from said sliding button for facilitating said operation of said thumbwheel.

14. The igniter, as recited in claim 9, wherein said thumbwheel is rotatably mounted at said sliding button at a position that a serrated portion of said thumbwheel is exposed from said sliding button for facilitating said operation of said thumbwheel.

15. The igniter, as recited in claim 12, wherein said thumbwheel is rotatably mounted at said sliding button at a position that a serrated portion of said thumbwheel is exposed from said sliding button for facilitating said operation of said thumbwheel.

16. The igniter, as recited in claim 1, wherein said igniting means and said gas supply are positioned at upper and bottom portions of said housing respectively that said sliding button is operatively coupled between said igniting means and said gas supply, wherein when said thumbwheel is upwardly rotated to unlock said sliding button, said sliding button is downwardly slid to open said outlet valve and activate said igniting means to complete ignition at said combustion nozzle.

17. The igniter, as recited in claim 4, wherein said igniting means and said gas supply are positioned at upper and bottom portions of said housing respectively that said sliding button is operatively coupled between said igniting means and said gas supply, wherein when said thumbwheel is upwardly rotated to unlock said sliding button, said sliding button is downwardly slid to open said outlet valve and activate said igniting means to complete ignition at said combustion nozzle.

18. The igniter, as recited in claim 6, wherein said igniting means and said gas supply are positioned at upper and bottom portions of said housing respectively that said sliding button is operatively coupled between said igniting means and said gas supply, wherein when said thumbwheel is upwardly rotated to unlock said sliding button, said sliding button is downwardly slid to open said outlet valve and activate said igniting means to complete ignition at said combustion nozzle.

19. The igniter, as recited in claim 14, wherein said igniting means and said gas supply are positioned at upper and bottom portions of said housing respectively that said sliding button is operatively coupled between said igniting means and said gas supply, wherein when said thumbwheel is upwardly rotated to unlock said sliding button, said sliding button is downwardly slid to open said outlet valve and activate said igniting means to complete ignition at said combustion nozzle.

20. The igniter, as recited in claim 15, wherein said igniting means and said gas supply are positioned at upper and bottom portions of said housing respectively that said sliding button is operatively coupled between said igniting means and said gas supply, wherein when said thumbwheel is upwardly rotated to unlock said sliding button, said sliding button is downwardly slid to open said outlet valve and activate said igniting means to complete ignition at said combustion nozzle.

* * * * *